US007406151B1

(12) United States Patent
Yun et al.

(10) Patent No.: US 7,406,151 B1
(45) Date of Patent: Jul. 29, 2008

(54) X-RAY MICROSCOPE WITH MICROFOCUS SOURCE AND WOLTER CONDENSER

(75) Inventors: Wenbing Yun, Walnut Creek, CA (US); Yuxin Wang, Arlington Heights, IL (US); Michael Feser, Martinez, CA (US); Frederick W. Duewer, Albany, CA (US)

(73) Assignee: Xradia, Inc., Concord, CA (US)

( * ) Notice: Subject to any disclaimer, the term of this patent is extended or adjusted under 35 U.S.C. 154(b) by 65 days.

(21) Appl. No.: 11/533,863

(22) Filed: Sep. 21, 2006

Related U.S. Application Data

(63) Continuation-in-part of application No. 11/458,622, filed on Jul. 19, 2006, now abandoned.

(60) Provisional application No. 60/700,615, filed on Jul. 19, 2005.

(51) Int. Cl.
*G21K 7/00* (2006.01)

(52) U.S. Cl. ..... 378/43

(58) Field of Classification Search ..... 378/43
See application file for complete search history.

(56) References Cited

U.S. PATENT DOCUMENTS

| | | | | | |
|---|---|---|---|---|---|
| 2,759,106 | A * | 8/1956 | Wolter | ..... | 378/43 |
| 5,216,699 | A * | 6/1993 | Iketaki | ..... | 378/43 |
| 5,351,279 | A * | 9/1994 | She et al. | ..... | 378/43 |
| 5,434,910 | A * | 7/1995 | Johnson et al. | ..... | 379/88.15 |
| 5,497,008 | A * | 3/1996 | Kumakhov | ..... | 250/505.1 |
| 5,590,168 | A * | 12/1996 | Iketaki | ..... | 378/43 |
| 5,744,813 | A * | 4/1998 | Kumakhov | ..... | 250/505.1 |
| 6,278,764 | B1 * | 8/2001 | Barbee et al. | ..... | 378/84 |
| 6,330,301 | B1 * | 12/2001 | Jiang | ..... | 378/85 |
| 6,389,101 | B1 * | 5/2002 | Levine et al. | ..... | 378/85 |
| 6,560,312 | B2 * | 5/2003 | Cash | ..... | 378/65 |
| 6,859,516 | B2 * | 2/2005 | Schneider et al. | ..... | 378/43 |
| 6,996,207 | B2 * | 2/2006 | Kumakhov | ..... | 378/43 |
| 7,057,187 | B1 | 6/2006 | Yun et al. | | |
| 7,365,918 | B1 | 4/2008 | Yun et al. | | |
| 2004/0125442 | A1 | 7/2004 | Yun et al. | | |

OTHER PUBLICATIONS

Larabell, Carolyn A., et al., "X-ray Tomography Generates 3-D Reconstructions of the Yeast, *Saccharomyces cerevisiae*, at 60-nm Resolution," Molecular Biology of the Cell, vol. 15, pp. 957-962, Mar. 2004.

Svergun, Dmitri I., et al., "Small-angle scattering studies of biological macromolecules in solution," Reports on Progress in Physics, vol. 66 pp. 1735-1782, 2003.

Schneider, G., et al., "Computed Tomography of Cryogenic Cells," Surface Review and Letters, vol. 9, No. 1, pp. 177-183, 2002.

* cited by examiner

*Primary Examiner*—Edward J. Glick
*Assistant Examiner*—Thomas R Artman
(74) *Attorney, Agent, or Firm*—Houston Eliseeva LLP

(57) ABSTRACT

An x-ray microscope uses a microfocus x-ray source with a focus spot of less than 10 micrometers and a Wolter condenser having a magnification of about four or more for concentrating x-rays from the source onto a sample. A detector is provided for detecting the x-rays after interaction with the sample, and an x-ray objective is used to form an image of the sample on the detector. The use of the Wolter optic addresses a problem with microfocus sources that arise when the size of the focal spot that must then be imaged onto the sample with the condenser is smaller than the field of view.

14 Claims, 2 Drawing Sheets

X-RAY MICROSCOPE WITH MICROFOCUS SOURCE AND WOLTER CONDENSER

RELATED APPLICATIONS

This application is a Continuation-in-Part of copending U.S. application Ser. No. 11/458,622 filed on Jul. 19, 2006, which claims the benefit under 35 USC 119(e) of U.S. Provisional Application No. 60/700,615, filed on Jul. 19, 2005 both of which are incorporated herein by reference in their entirety.

BACKGROUND OF THE INVENTION

Generally, an x-ray microscope comprises an x-ray source, a condenser for concentrating the x-rays from the source onto the sample, a detector for detecting the x-rays after interaction with the sample, and an x-ray objective, such a zone plate lens. The objective forms the image on the detector.

Using sources that generate multi-keV x-rays with a high brilliance are important when good penetration through the sample is required. This penetration enables three dimensional imaging and provides good depth of field in the microscopes. The high cost of such sources, however, has limited the wide deployment of the x-ray microscopes for such applications.

A number of different methods can be used to generate the high brilliance multi-keV x-rays. The first two methods are based on improving the thermal dissipation problem that limited the first x-ray generator invented by Roentgen, which produced x-rays by bombarding a solid target anode with energetic electrons. The brilliance of an electron bombardment source is proportional to the flux density of energetic electrons impinging on the x-ray target anode. The brightness is limited by the maximum electron density that can be applied to the target before it melts due to high heat flux. The first method permits thermal dissipation by using a fast rotating anode target to spread the heat flux over a large area and thereby prevent the target from melting. X-ray sources based on this method are powerful and widely used in laboratory environments. The second method uses a micro-sized electron spot (microfocus source) to reduce the thermal path to produce a large thermal gradient for better thermal dissipation. The third method involves an accelerator/synchrotron. The fourth method uses a high power laser beam focused to a small spot on a target to produce high temperature plasmas that emit high brilliance x-rays.

Of these options, only the microfocus source is low enough in cost for many emerging x-ray microscopy applications and generates the energetic x-rays. Synchrotron sources are brilliant but very expensive and only a relatively few exist. The laser systems are limited to soft x-rays and not well suited for multi-keV x-rays. Rotating anode sources have been widely deployed but are typically about 3-6 times more expensive than a microfocus source.

In addition, microfocus x-ray sources have a further advantage since they can be significantly more brilliant than rotating anode sources. It is important to compare the relative figure of merit of commercially available and widely deployed rotating anode sources against microfocus x-ray sources. Their brilliance $B_c$ is given by, $$B_c \sim P/A^2, \quad (1)$$

where P and A are the power and the diameter of the electron beam incident on the target (anode), respectively. While a rotating anode typically produces much larger x-ray flux, microfocus x-ray sources can be substantially more brilliant than rotating anode sources. For example, the maximum thermal loading of a widely deployed rotating anode is quoted as 1.2 kilo Watts (kW) over an electron spot size of 100 micrometers. In contrast, a microfocus x-ray source from Hamamatsu is specified to provide 5 Watts (W) and 10 W over an electron spot size of 4 and 7 micrometers, respectively. Based on these specifications and equation (1), it is apparent that the microfocus x-ray source is about 2.6 and 1.7 times more brilliant than the rotating anode for the 4 and 7 micrometers x-ray spot sizes, respectively. Based on the analysis above, a microfocus x-ray source with a one micrometer spot size can have a power loading of 1.2 W. The brilliance of such an x-ray source will be 10 times higher than a rotating anode source.

SUMMARY OF THE INVENTION

The problem with microfocus sources is the size of the focal spot that must then be imaged onto the sample with the condenser as it may not be large enough to fill the field of view of the microscope.

In general, according to one aspect, the invention features an x-ray microscope, comprising a microfocus x-ray source with a focus spot of less than 10 micrometers and a Wolter condenser having a magnification of about four or more for concentrating x-rays from the source onto a sample. A detector is provided for detecting the x-rays after interaction with the sample, and an x-ray objective is used to form an image of the sample on the detector.

Often, the focus spot of the x-ray source is 4-7 micrometers in diameter. In one set of embodiments, however, the focus spot of the x-ray source is about 1 micrometer or less in diameter. Because of this small spot, the Wolter condenser preferably has a magnification of ten or more in order to fill the field of view of the microscope.

In the preferred embodiments, the Wolter condenser comprises glass capillary tube. In one example, the Wolter condenser comprises two pieces of glass capillary tube bonded together. In another embodiment, the optic comprises a unitary piece of capillary tube.

To provide good magnification, a length of an ellipsoidal segment of the condenser is 1.5 or more times longer an hyperbolic segment. Also, the x-rays have an energy of 2 or more kilo electron-volts are preferably used along with a zone plate x-ray objective.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
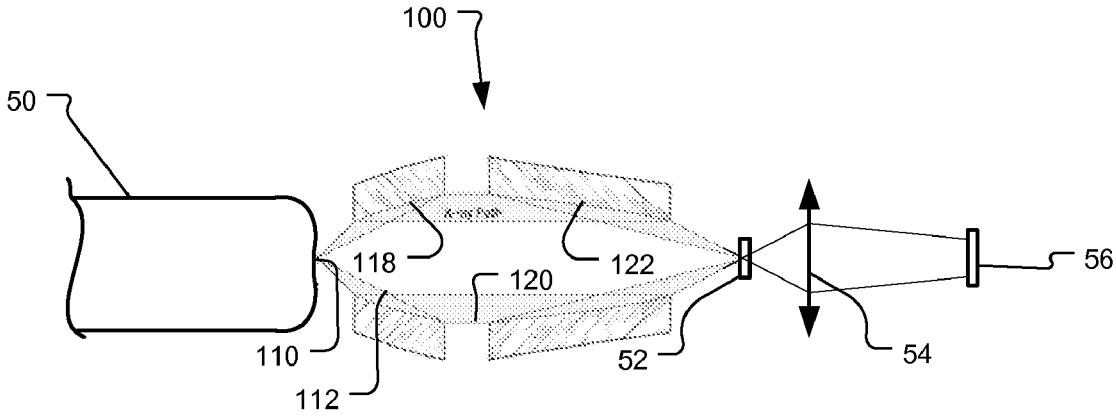
FIG. 1 is a side schematic view of an x-ray microscope according to the present invention.

The problem that arises when using such microfocus sources in x-ray microscopes concerns the microscopes' field of view, which are usually much larger than the microfocus source's size. For example, for an x-ray microscope with 25 nanometer (nm) resolution and 1000×1000 detector pixels, a desirable field of view is about 10 micrometers (μm) assuming a 2.5 times sampling per resolution element. For a one micrometer diameter microfocus x-ray source, the condenser needs to magnify the source by more than 10 times to illuminate this field of view.

Currently, the most efficient x-ray condensers for x-ray microscopes are suitably configured mirrors operating at grazing incidence. For grazing incidence angles smaller than the critical angle for total reflection, X-ray reflectivity for most mirror materials is typically better than 85% for multi kilo electron-Volts (keV) x-rays.

In x-ray microscopes using synchrotron x-ray sources, common focusing mirrors include torroidal mirrors and Kirkpatrick-Baez (KB) mirrors. Although sub-micrometer focal spots are routinely obtained with a well designed KB mirrors, the good focusing property of the KB mirrors are only maintained for imaging to a point exactly on the optical axis, which results in poor focusing off-axis. Consequently they do not have an adequate field of view. Also, for large magnification, imaging aberrations get progressively worse, and the numerical aperture is limited for a magnifying geometry by the critical angle (larger magnification requires large reflection angles).

This requirement of a large optical magnification also calls for a condenser with a large numerical aperture (NA), in fact much larger than the NA of the imaging objective, assuming that the illumination is matched. In the case of a magnifying condenser, the NA of the condenser is dominated by the opening angle on the source side. For larger magnifications, the required NA of the condenser is larger than the NA of the objective, approximately by a factor equal to the magnification required. The numerical aperture required for a given source magnification M, to keep a desired $\Delta\theta$, is given by $$NA=M\Delta\theta. \quad (2)$$

For example, for M=10 and $\Delta\theta$=3 mrad (the corresponding zone plate objective have an outermost zone width of about 25 nm for 8 keV x-rays), a condenser with a NA of ~30 mrad is required. To utilize the high brilliance of a microfocus x-ray source using a zone plate condenser, the zone plate would need an outermost zone width of 2.5 nm. For this reason the use of zone plate condensers is not feasible.

In order for an optical system to form an image with negligible aberrations, astigmatism and coma, the principle surface, defined as the locus of the intersections of the initial and final ray paths, must satisfy the Abbe sine condition. Abbe condition is equivalent to the requirement that all geometrical paths through the principle optical surface result in the same magnification. A single ellipsoidal mirror can only focus rays from one of its two foci to another without aberration because of equal optical path length. However, images of off-axis points will be blurred because the Abbe condition is not satisfied, especially at grazing incidence, as the principle surface is the ellipsoid and the magnification of the object varies along the surface of the mirror. In microscope terminology, a single reflective mirror, such an ellipsoid or paraboloid, does not have a field of view. Typically, the above mentioned imaging problems are corrected using compound systems, where the radiation is reflected at grazing incidence from two or more spherical or aspherical surfaces. In 1952 Hans Wolter showed that by using a compound system consisting of a hyperboloid and an ellipsoid, the Abbe sine condition can be approximately satisfied.

According to the invention, a Wolter optic condenser is used. It will cut exposure times into a small fraction of what currently is available and will lower the total cost of the x-ray microscope since lower cost x-ray sources can be employed.

Shown in FIG. 1 is transmission X-ray microscope according to the present invention. It includes a microfocus X-ray source 50 that generates x-rays. The condenser 100 collects and concentrates these x-rays on a sample or object 52. An objective lens 54 collects the x-rays from the object 52 and focuses them on a detector 56.

In the preferred embodiments, the objective lens 54 is a zone plate lens. This enables absorption-contrast imagine of the object 52. In another embodiment, a Zerneke-phase contrast configuration with the addition of a phase ring to image the phase shift through the sample. In one implementation, composite zone plate/phase plate is used as disclosed in U.S. Pat. Publication No. 20040125442 A1, which is incorporated herein in its entirety by this reference. In still other embodiments, the objective is compound refractive lens or Wolter mirror.

The detector 56 usually comprises a scintillator and a spatially resolved detector device, such as a charge-coupled device. An intervening visible light magnification optical train such as disclosed in U.S. Pat. No. 7,057,187B1 that issued on Jun. 6, 2006 to Wang, et al., which is incorporated herein by this reference in its entirety, is also used in some implementations.

The microfocus source 50 uses energetic electron bombardment of a solid target anode. The bombardment is localized to a micro-sized spot, thereby reducing the thermal path and producing a large thermal gradient for improved thermal dissipation. Preferably, the source 50 has and operates with a focal spot size of less than 10 micrometers, and is usually about 4-7 micrometers or less in diameter. In the preferred embodiment, the focal spot size of the source is about 1 micrometer or less. The anode is preferably stationary, i.e, non rotating.

To fully illuminate an area of sample 52, the focal spot size of the microfocus source 50 is magnified many times by the condenser 100. Preferably, the condenser 100 magnifies source focal spot 110 by greater than about 4 times. Preferably the magnification is about 10 or more, and can be as high as 20 or more.

Further, the condenser 100 preferably has a high numerical aperture (NA). In the preferred embodiment, it is greater than about 20 mrad, and is about 30 mrad or greater.

The condenser 100 functions in this full field x-ray microscope to collect x-rays from the source 50 and then focus them onto an object or sample 52, which is similar to a condenser in a typical optical microscope. Desirable important parameters typically include: (1) high efficiency of relaying the radiation from the source 50 to the object 52, large numerical aperture (NA) typically required to match that of the objective 54 to achieve high resolution and high throughput, and adequate imaging property to preserve the source brightness for high throughput and achieve a desired illumination condition for a particular imaging modality, such as phase contrast imaging.

For throughput, the figure of merit of an illumination system having a condenser 100 and a source 50 in a full field x-ray microscope can be defined as the flux F (in photons per second) incident on the object, $$F=\eta B_c L^2 \Delta\theta^2, \quad (3)$$

where $B_c$, L, and $\Delta\theta$ are the beam brilliance, the field of view, and the divergence of the illumination beam at the object, respectively; $\eta$ the efficiency of the condenser. An x-ray microscope with 25 nanometer (nm) resolution, a field of view L of 10 micrometers (μm) is considered to be adequate for many applications. For a 1000 by 1000 pixel array detector, the 10-μm field of view corresponds to about 10 nm pixel size on the object and each resolution element contains about $2.5^2=6.25$ pixels. The divergence of the beam $\Delta\theta$ is typically set equal to about two times of the numerical aperture of the objective lens.

Expression (3) shows that for a given field of view L and divergence $\Delta\theta$, F is proportional to the product of the focusing efficiency $\eta$ and the source brilliance $B_c$. In general, the exposure time required to image certain features inside the object 52 is inversely proportional to F. For a given exposure time, the signal to noise ratio of the image is proportional to the square root of F. Therefore, the combination of the brilliant microfocus x-ray source 50 and the efficient Wolter condenser 100 yields an effective yet relatively inexpensive system.

To make effective use of the high brilliance of a microfocus x-ray source for microscopy, the condenser must collect x-rays from the source and focus them on to the object with high efficiency and an adequate field of view without reducing the source brilliance. Specifically, the requirements of the desired condenser include: focusing efficiency as close to 100% as possible; magnification of the source spot size to match the designed field of view; generation of an illumination beam at the object plane with a numerical aperture (or angular distribution) matching that of the objective lens; and point spread function smaller than or comparable to the source size.

The expression for the flux incident on the sample in Eq. 3 assumes that the condenser does not have significant imaging aberrations. Condenser lenses do not have to be perfect in terms of the typical imaging aberrations like spherical aberration and astigmatism, because they do not form the high resolution image, but only provide the illumination for imaging by the objective lens. However, a poor condenser lens images a point to an extended area, which can be described by a point spread function. For a Wolter-type condenser this point spread function is approximately field independent and can be understood in terms of a "blurring" of the image, similar to an out of focus image. This blurring reduces the effective brightness of the x-ray beam at the sample. If we assume a Gaussian source and a Gaussian point spread function for the condenser, we can mathematically describe the effective brightness at the sample $B_c$ in terms of the source brightness B, the Gaussian source size S and the point spread function $\delta$ as:

$$B_c = \frac{S^2}{S^2+\delta^2} B. \quad (4)$$

Eq. 4 illustrates that there can be significant degradation of the source brightness B, i.e., $B_c$ is smaller than B, if $\delta$ is comparable to or larger than S. It is therefore important to have $\delta$ much smaller than S to avoid the reduction of the source brightness B by imperfections of the focusing optic.

Figure 2A:
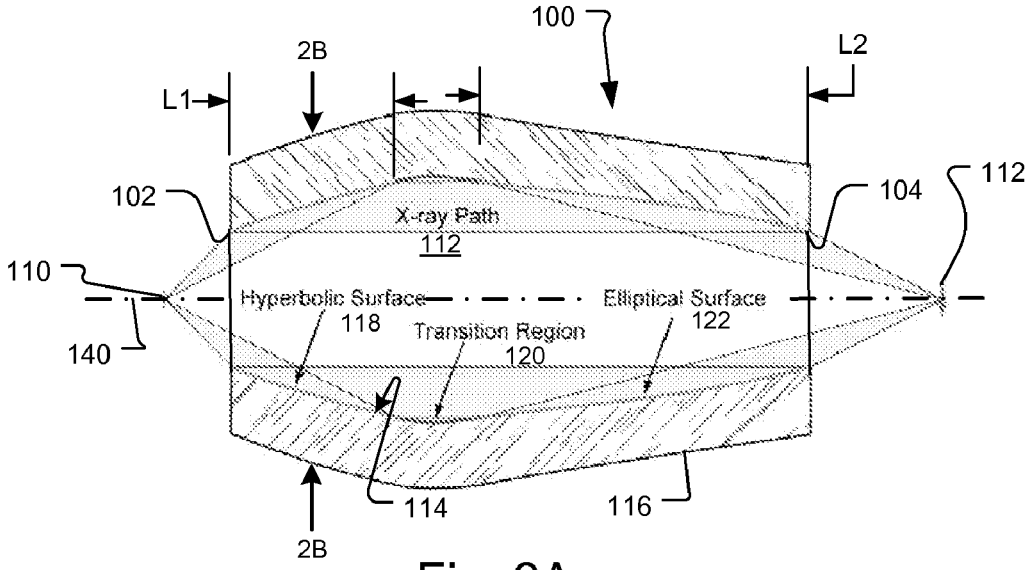
FIGS. 2A and 2B are side cross sectional and midline cross sectional views of a Wolter condenser optic according to the present invention.
Figure 2B:
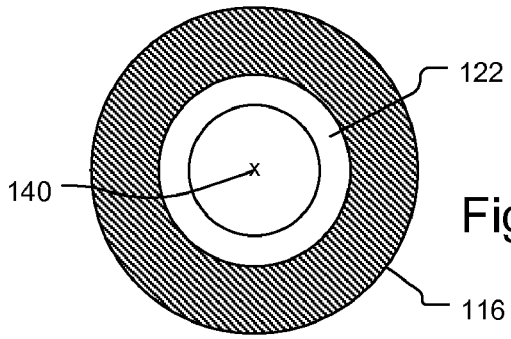

FIGS. 2A and 2B illustrate a first embodiment of the Wolter-type condenser 100. FIG. 2A is a side cross sectional view through the center optical axis 140. FIG. 2B is a midline cross sectional view orthogonal to the optical axis 140 at line 2B in FIG. 2A, showing the rotational symmetry about the optical axis 140. Its x-ray path 112 is defined within the inner surface 114 of monolithic body condenser body 116. Inner surface 114 includes hyperbolic section or surface 118, a transition section 120, and elliptical section or surface 122.

Higher magnification can be obtained with a Wolter-type condenser in which the length of the ellipsoidal segment is longer, preferably several times longer, than the hyperbolic segment. In preferred embodiment of the invention, length L2 is at least 1.5 to 2 times longer than length L1.

In one embodiment, the monolithic body 116 is a glass capillary tube. Preferably, the capillary tube has an inner surface that is straight, reflecting and characterized by a well defined slope.

In some implementations, the inner surface 114 reflecting the x-rays, i.e., hyperbolic section or surface 118 and elliptical section or surface 122, are coated to improve reflection efficiency. In one case a metal coating is used such as nickel, gold, silver or tungsten. In another case, multilayer, thin film coatings are used such as coatings comprising alternating layers of tungsten and silicon or molybdenum and silicon.

Figure 3:
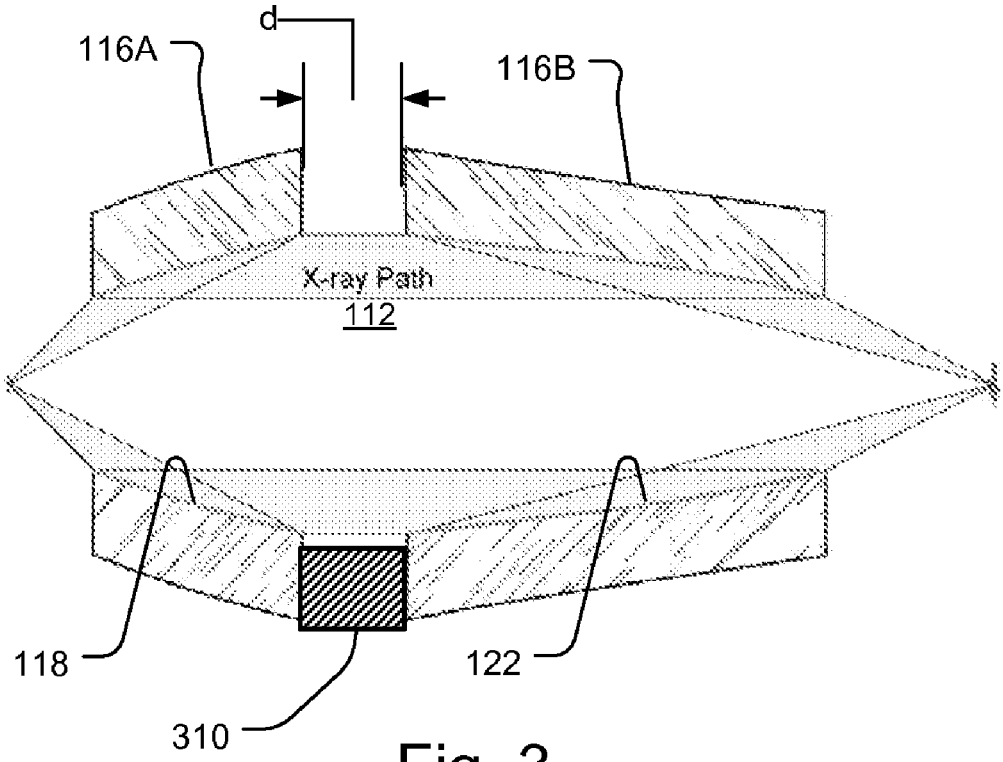
FIG. 3 is a side cross sectional view a Wolter condenser optic according to another embodiment.

FIG. 3 shows another embodiment of the condenser. This is a non-monolithic Wolter-type condenser. This split Wolter-type condenser includes front segment 116A and back segment 116B. Front segment 116A has inner surface 118 that is hyperbolic. Hyperbolic inner surface 114 is aligned, preferably in permanent fashion, with elliptical inner surface 122 of back segment 116B. The alignment is preferably fixed by aligning and then bonding (see epoxy bond 310) segments 116A and 116B to each other.

Segments 116A and 116B are separated by distance d that is determined by x-ray path parameters. The advantage of this embodiment is that the two segments are manufactured from the glass capillary tubing separately thereby improving yield.

While this invention has been particularly shown and described with references to preferred embodiments thereof, it will be understood by those skilled in the art that various changes in form and details may be made therein without departing from the scope of the invention encompassed by the appended claims.

What is claimed is:

1. An x-ray microscope, comprising:

a microfocus x-ray source with a focus spot of less than 10 micrometers;

a Wolter condenser having a magnification of about two or more for magnifying and imaging the focus spot from the source onto a sample and concentrating x-rays from the source onto the sample;

a detector for detecting the x-rays after interaction with the sample; and an x-ray objective for forming an image of the sample on the detector.

2. An x-ray microscope as claimed in claim 1, wherein the focus spot of the x-ray source is 4-7 micrometers in diameter.

3. An x-ray microscope as claimed in claim 1, wherein the focus spot of the x-ray source is about 1 micrometer or less in diameter.

4. An x-ray microscope as claimed in claim 1, wherein the Wolter condenser has a magnification of four or more.

5. An x-ray microscope as claimed in claim 1, wherein the Wolter condenser comprises a glass capillary tube.

6. An x-ray microscope as claimed in claim 5, wherein the glass capillary tube comprises an inner metal coating.

7. An x-ray microscope as claimed in claim 5, wherein the glass capillary tube comprises a thin film coating comprising alternating layers of different elements.

8. An x-ray microscope as claimed in claim 1, wherein the Wolter condenser comprises two pieces of glass capillary tube bonded together.

9. An x-ray microscope, comprising:

a microfocus x-ray source with a focus spot of less than 10 micrometers;

a Wolter condenser having a magnification of about two or more for concentrating x-rays from the source onto a sample;

a detector for detecting the x-rays after interaction with the sample; and an x-ray objective for forming an image of the sample on the detector;

wherein a length of an ellipsoidal segment of the condenser is 1.5 or more times longer than an hyperbolic segment.

10. An x-ray microscope as claimed in claim 1, wherein the x-rays have an energy of 1 or more kilo electron-volts.

11. An x-ray microscope as claimed in claim 1, wherein the x-ray objective is a zone plate.

12. An x-ray microscope as claimed in claim 1, wherein the x-ray objective is a compound refractive lens.

13. An x-ray microscope as claimed in claim 1, wherein the x-ray objective is a Wolter mirror.

14. An x-ray microscope as claimed in claim 1, being arranged in phase contrast configuration with a phase ring to image the phase shift through the sample.

* * * * *